US005123431A

United States Patent [19]

Wilson

[11] Patent Number: 5,123,431

[45] Date of Patent: Jun. 23, 1992

[54] COSMETIC APPLICATOR AND TIP THEREFOR

[75] Inventor: James E. Wilson, Bound Brook, N.J.

[73] Assignee: Revlon, Inc., New York, N.Y.

[21] Appl. No.: 548,650

[22] Filed: Jul. 5, 1990

[51] Int. Cl.[5] ..... A45D 40/26

[52] U.S. Cl. ..... 132/320; 401/119; 401/130; 604/1

[58] Field of Search ..... 132/320, 317; 604/1; 401/119, 130

[56] References Cited

U.S. PATENT DOCUMENTS

| | | | |
|---|---|---|---|
| 2,029,835 | 2/1936 | Reichle | 401/119 |
| 3,071,143 | 1/1963 | Bau | 401/128 |
| 3,073,320 | 1/1963 | Seaver | 401/121 |
| 3,896,823 | 7/1975 | Spatz | 132/218 |
| 3,930,280 | 1/1976 | Vasas | 15/257.05 |
| 4,213,472 | 7/1980 | Gueret et al. | 132/320 |
| 4,403,624 | 9/1983 | Montgomery | 132/218 |
| 4,446,880 | 5/1984 | Gueret et al. | 132/218 |
| 4,545,393 | 10/1985 | Gueret et al. | 132/218 |
| 4,635,659 | 1/1987 | Spatz | 132/218 |
| 4,660,582 | 4/1987 | Taylor | 132/218 |
| 4,935,001 | 6/1990 | George | 401/119 |

*Primary Examiner*—Gene Mancene
*Assistant Examiner*—Adriene B. Lepiane
*Attorney, Agent, or Firm*—Julie Blackburn

[57] ABSTRACT

A cosmetic applicator tip has a plurality of dimples on an exterior surface thereof for receiving and dispensing a cosmetic. The tip is injection molded from a soft material to provide the tip with a pleasing "feel" when rubbed against the skin of a user. An air cushion within the tip can be varied to adjust or regulate the "feel" of the tip.

31 Claims, 2 Drawing Sheets

COSMETIC APPLICATOR AND TIP THEREFOR

FIELD OF THE INVENTION

The present invention relates to a cosmetic applicator, and, more particularly, to such an applicator provided with an elastomeric tip having a dimpled surface to assist in the transfer of cosmetic from a receptacle to the skin of a user.

BACKGROUND OF THE INVENTION

Numerous types of cosmetic applicators are known in the art. Of most direct pertinence to the present invention is the sponge-tipped applicator frequently used for applying caked cosmetic powders, such as, eyeshadow. Sponge-tipped applicators are used by brushing them across the surface of a cosmetic cake, whereupon the irregular surface of the sponge material scrapes a small portion of cosmetic from the surface which packs into the "pores" of the sponge. Having collected a small portion of cosmetic in the pores of the sponge tip, the user may then brush the tip over the surface of the skin, whereupon a thin layer of cosmetic is dispensed from the tip and deposited upon the skin. Since the applicator tip is drawn across the skin of the user with sufficient pressure to abrade retained cosmetic from the tip, it is desirable to manufacture the tip from a material which is not in itself, abrasive to the skin. This is especially true with regard to the application of cosmetic to areas of the face which are sensitive, such as, the eyelids. In this respect, sponge material is less than optimal in that it is somewhat abrasive. In addition, the porosity of sponge material is irregular and the capacity of a sponge to carry and dispense cosmetics varies over its surface area. Another deficiency of applicator tips of sponge material is the method by which they are affixed to the stem portion of the applicator. Since the sponge has minimal structural resiliency, it is usually glued to the stem of the applicator. The gluing operation is messy as well as time and labor intensive. Specifically, a proper amount of glue must be delivered to the applicator tip, the glue must be kept isolated from the surface of the applicator and the gripping portion of the stem, the tip and stem must be oriented for assembly and the two parts brought together before the glue has set or skinned over. After assembly, the glue joint must remain undisturbed until it dries.

In addition to the common sponge-tipped applicator, certain other applicator tips have been proposed. For example, in the field of mascara applicator tips, U.S. Pat. No. 4,660,582, 4,635,659, and 4,545,393 disclose molded plastic or rubber cosmetic applicator tips for collecting mascara from a receptacle and depositing it on the eyelashes of a user. The applicators disclosed in these patents employ an applicator tip utilizing radial projections emanating from a stem. The projections are sized and spaced to match the dimensions of the eyelashes of a person and for directing the eyelashes into channels between the projections where a deposit of mascara has been collected. The applicators are rotated against the eyelashes to permit a transfer of mascara from the applicator to the lashes.

SUMMARY OF THE INVENTION

In accordance with the present invention, the problems and disadvantages of the prior art devices discussed above are overcome by making a cosmetic applicator tip from a soft material and forming a plurality of dimples on an exterior surface of the tip. Each of the dimples is sized and shaped so as to releasably retain a predetermined quantity of cosmetic which is "picked up" (i.e., collected) by the dimples when the tip is rubbed against a cosmetic product and which is "paid off" (i.e., deposited) onto a user when the tip is rubbed against the user's skin.

Because the tip is made from a soft material (e.g., one having a hardness in a range of from about 6 durometer Shore A to about 40 durometer Shore A), the tip has a pleasing "feel". The "feel" of the tip can be adjusted or regulated by providing the tip with an internal air cushion. By making the tip from a moldable material, such as a thermoplastic elastomer, the tip can be injection molded, thereby facilitating its mass production.

BRIEF DESCRIPTION OF THE DRAWINGS

For a better understanding of the present invention, reference is made to the following detailed description of an exemplary embodiment considered in conjunction with the accompanying drawings, in which.

DESCRIPTION OF THE EXEMPLARY EMBODIMENTS

Figure 1:
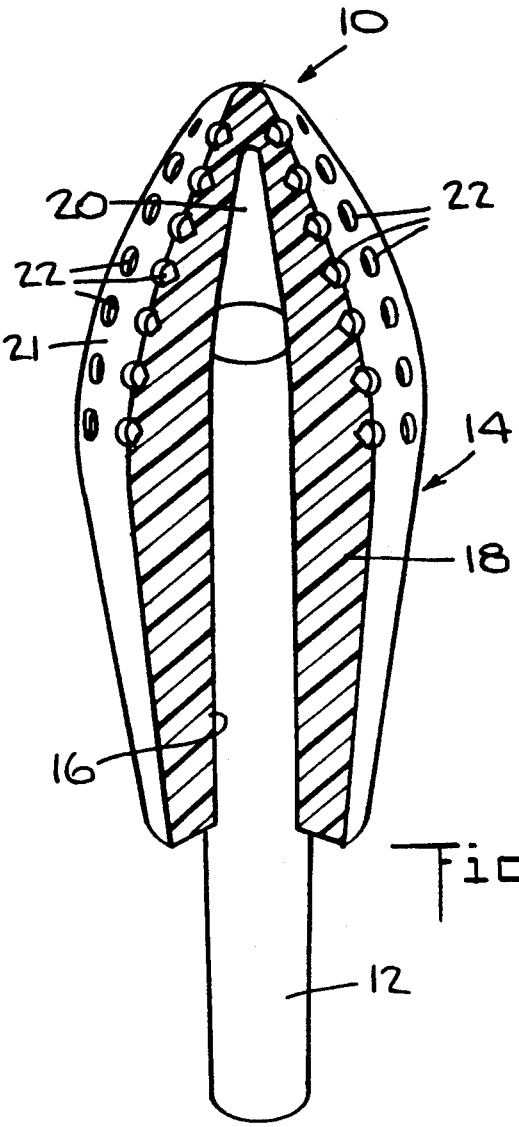
FIG. 1 is a perspective, partial cross-sectional view of a cosmetic applicator constructed in accordance with an exemplary embodiment of the present invention.

Referring to FIG. 1, there is shown a cosmetic applicator 10 having a substantially cylindrical, rigid thermoplastic stem 12 upon which has been slideably fitted and frictionally retained a resilient cosmetic applicator tip 14. The tip 14 is preferably composed of a soft, non-porous, thermoplastic elastomer, such as a thermoplastic urethane or an isoprene rubber (e.g., SANTOPRENE®, a product of the Monsanto Corp.), which can be molded into the tip 14 by, for instance, a conventional injection molding process. Materials of this type typically exhibit a hardness of 6 durometer Shore A to 40 durometer Shore A. The softness of the tip 14 makes it especially well suited for applying eye shadow to eyelids.

The tip 14 has a hollow core 16 delimited by a surrounding wall 18. The hollow core 16 is dimensioned to slideably receive the stem 12 and to grip it firmly enough to prevent inadvertent removal during use. The assembly of the tip 14 to the stem 12 is amenable to mechanization and thus eliminates labor intensive alternatives. The depth of insertion of the stem 12 into the core 16 of the tip 14 determines, in part, the overall firmness or "feel" of the tip 14 by varying the size of an internal cavity 20, which functions as an air cushion. As the tip 14 is preferably manufactured of a flexible material, the degree of insertion of the stem 12 into the tip 14 is adjustable within a range and thereby permits the overall firmness of the tip 14 to be adjusted to suit the preference of the user and the demands of the intended use. For example, it may be preferable to produce a firmer tip 14 for the application of lipstick than that used to apply eye shadow. Similarly, it may be preferable to produce a firmer tip for applying rub-on blush than that used to apply lip cosmetics. Thus, the firmness of the tip can be selected for optimum performance depending principally upon the characteristics of the cosmetic to be applied and the sensitivity of the area upon which it is used. The "feel" of the tip 14 can also be regulated by varying the thickness of the wall 18 and hence the size of the internal cavity 20.

The tip 14 is bullet-shaped and has a multiple of cosmetic accumulating depressions or dimples 22 disposed uniformly on a curved exterior surface 21, the dimples 22 being formed in the exterior surface 21 during the molding of the tip 14 or, in the alternative, during a post-molding operation. The shape of the tip 14 permits it to be loaded with a cosmetic product by twisting the stem 12 between the fingers while holding the rotating tip 14 in contact with the cosmetic product. The pointed end of the tip 14 and its flexible composition allow it to reach into otherwise inaccessible corners and crevices of a cosmetic container and thereby permit total usage of the cosmetic product eliminating waste.

Figure 2:
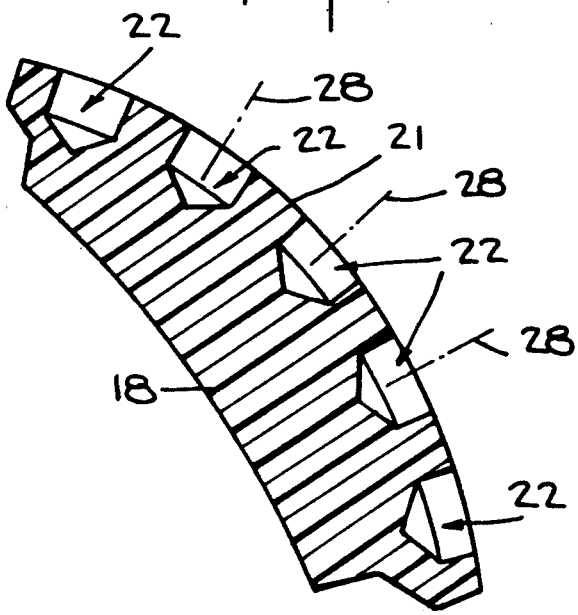
FIG. 2 is a cross-sectional view of a portion of the cosmetic applicator illustrated in FIG. 1.
Figure 3:
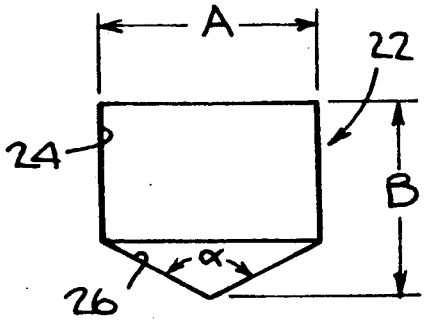
FIG. 3 is a schematic illustration of a dimple formed in the surface of the cosmetic applicator illustrated in FIGS. 1 and 2.

With reference to FIGS. 2 and 3, it can be seen that each of the dimples 22 has a cylindrical portion 24 which extends inwardly from the exterior surface 21 and terminates inwardly in a converging point 26 forming an angle $\alpha$ (see FIG. 3) The value of $\alpha$ is preferably in a range of from about 110 degrees to about 130 degrees. To maximize cosmetic retention, the diameter A (see FIG. 3) of the cylindrical portion 24 is preferably in a range of from about 0.010 inches to about 0.020 inches. The depth B (see FIG. 3) of the dimples 22 should be in a range of from about 0.005 inches to about 0.015 inches. Each of the dimples 22 has a longitudinal axis 28 arranged generally at a right angle with respect to a line (not shown) which is tangent to the exterior surface 21 of the tip 14 at the point where such axis intersects the exterior surface 21.

Figure 4:
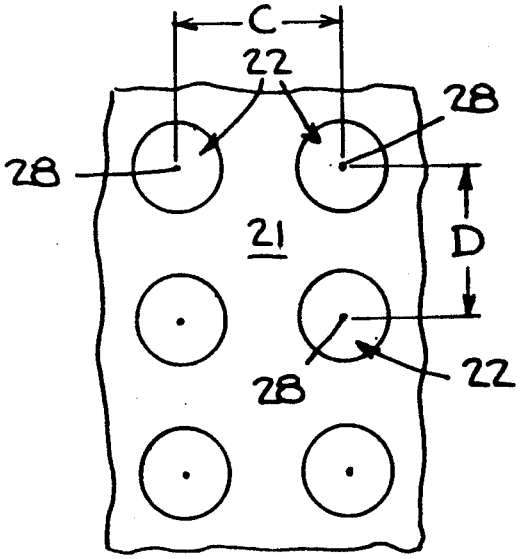
FIG. 4 is a top plane view showing the dimple pattern employed by the cosmetic applicator illustrated in FIGS. 1 and 2.

Referring now to FIG. 4, the spatial arrangement of the dimples 22 on the surface 21 of the tip 14 is shown. It has been determined that optimal cosmetic pickup, retention and dispensing is achieved if the lateral arcuate spacing C between adjacent pairs of the dimples 22 is in a range of from about 0.018 inches to about 0.025 inches and the longitudinal arcuate spacing D between adjacent pairs of the dimples 22 is in a range of from about 0.015 inches to about 0.025 inches.

Figure 6:
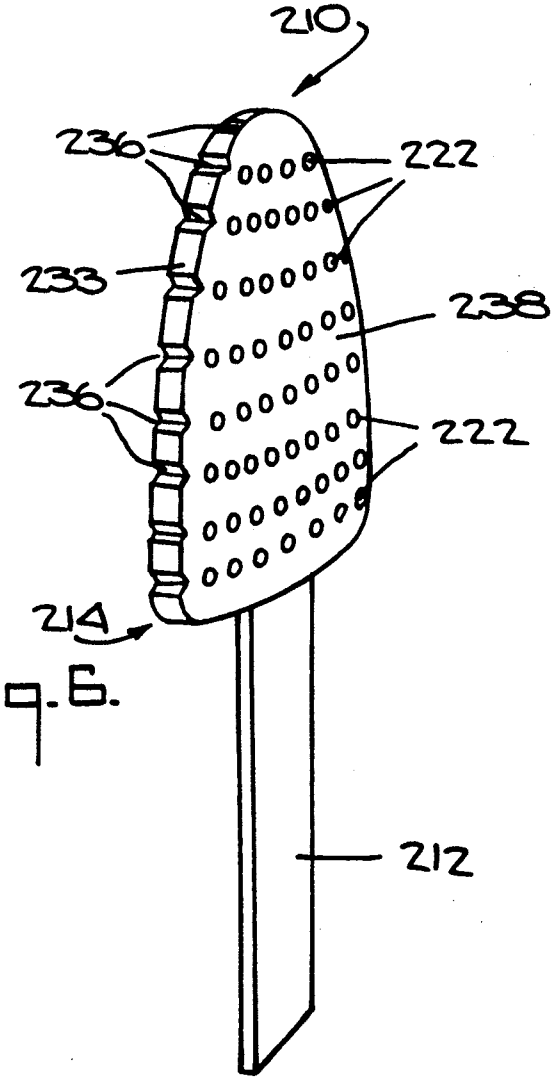
FIG. 6 is a perspective view of a cosmetic applicator constructed in accordance with yet another exemplary embodiment of the present invention.
Figure 5:
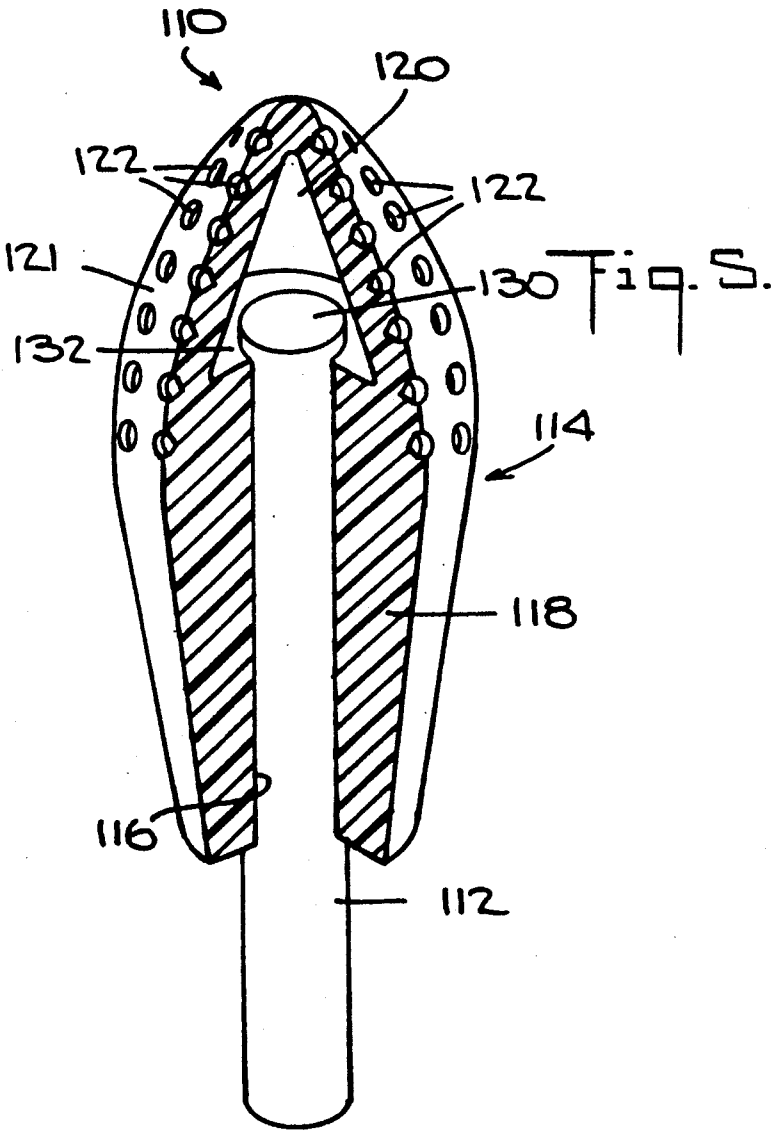
FIG. 5 is a perspective, partial cross-sectional view of a cosmetic applicator constructed in accordance with another exemplary embodiment of the present invention.

Two other exemplary embodiments of cosmetic applicators constructed in accordance with the present invention are illustrated in FIGS. 5 and 6. Elements illustrated in FIGS. 5 and 6 which correspond to the elements described above with respect to FIGS. 1–4 have been designated by corresponding reference numerals increased by 100 and 200, respectively. The embodiments of FIGS. 5 and 6 operate in the same manner as the embodiment of FIGS. 1–4 unless it is otherwise stated.

Referring now to FIG. 5, a stem 112 includes a flange 130 adapted to engage an internal platform 132 provided within a hollow core 116 of a tip 114. The flange 130 cooperates with the platform 132 to inhibit removal of the stem 112 from the tip 114.

With reference to FIG. 6, a tip 214 has a configuration which makes it especially well suited for rubbing it in a straight line across a cosmetic cake in contrast to the twisting rotary operation of the previously described embodiments. More particularly, the flattened tip 214 has a narrow peripheral edge 233 which serves as a specialized applicator surface for drawing thin lines with cosmetic. The peripheral edge 233 includes a series of lateral grooves 236. Preferably, the grooves 236 have a depth of about 0.005 to about 0.010 inches, a length approximating the width of the edge 233 (i.e., preferably in a range of from about 0.010 to about 0.030 inches), and a longitudinal spacing approximating that of dimples 222 formed in opposed, slightly convex faces 238 of the tip 214. Because of its relatively flat shape, the tip 214 is mounted on a relatively flat stem 212.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A cosmetic applicator tip, comprising a body made from a soft thermoplastic material and having an exterior surface provided with a plurality of dimples, each dimple having a cylindrical portion extending into said body from said exterior surface and a conical portion extending into said body from said cylindrical portion, said conical portion terminating in an apex at a point remote from said cylindrical portion each dimple releaseably retaining a predetermined quantity of cosmetic.

2. A cosmetic applicator tip according to claim 1, wherein said cylindrical portion of each of said dimples has a diameter in a range of from about 0.01 inches to about 0.02 inches.

3. A cosmetic applicator tip according to claim 2, wherein said apex of said conical portion of each of said dimples has an internal angle of convergence in a range of from about 110 degrees to about 130 degrees.

4. A cosmetic applicator tip according to claim 3, wherein each of said dimples extends into said body a distance in a range of from about 0.005 inches to about 0.015 inches.

5. A cosmetic applicator tip according to claim 1, wherein there is a multiplicity of said dimples, said dimples being uniformly distributed over said exterior surface of said body.

6. A cosmetic applicator tip according to claim 5, wherein said dimples are arranged in columns extending longitudinally along said external surface of said body and in rows extending laterally across said body.

7. A cosmetic applicator tip according to claim 6, wherein the center-to-center distance between dimples of adjacent columns is in a range of from about 0.018 inches to about 0.025 inches and wherein the center-to-center distance between dimples of adjacent rows is in a range of from about 0.015 inches to about 0.025 inches.

8. A cosmetic applicator tip according to claim 1, wherein said body includes receiving means within said body for receiving a quantity of air sufficient to form an air cushion within said body.

9. A cosmetic applicator tip according to claim 8, wherein said receiving means is a cavity formed within said body.

10. A cosmetic applicator tip according to claim 9, wherein the size of said cavity is adjustable to thereby vary the effect of said air cushion.

11. A cosmetic applicator tip according to claim 1, wherein said body is injection molded.

12. A cosmetic applicator tip according to claim 1, wherein said body is made from a thermoplastic elastomer.

13. A cosmetic applicator tip according to claim 12, wherein said thermoplastic elastomer has a hardness in a range of about 6 durometer Shore A to about 40 durometer Shore A.

14. A cosmetic applicator tip according to claim 1, wherein said body is bullet-shaped.

15. A cosmetic applicator tip according to claim 1, wherein said body has a pair of opposed, slightly convex faces and a peripheral edge interposed between said faces, wherein said dimples are formed on said faces only and wherein said peripheral edge has a plurality of laterally extending grooves, each groove being sized and shaped so as to releasably retain a predetermined quantity of cosmetic.

16. A cosmetic applicator, comprising a tip having a body made from a soft thermoplastic material, said body including an exterior surface provided with a plurality of dimples, each dimple having a cylindrical portion extending into said body from said exterior surface and a conical portion extending into said body from said cylindrical portion, said conical portion terminating in an apex at a point remote from said cylindrical portion each dimple releasably retaining a predetermined quantity of cosmetic, and gripping means attached to said body of said tip for providing a grippable surface by which the cosmetic applicator can be gripped by the user.

17. A cosmetic applicator according to claim 16, wherein said cylindrical portion of each of said dimples has a diameter in a range of from about 0.01 inches to about 0.02 inches.

18. A cosmetic applicator according to claim 17, wherein said apex of said conical portion of each of said dimples has an internal angle of convergence in a range of from about 110 degrees to about 130 degrees.

19. A cosmetic applicator according to claim 18, wherein each of said dimples extends into said body of said tip a distance in a range of from about 0.005 inches to about 0.015 inches.

20. A cosmetic applicator according to claim 16, wherein there is a multiplicity of said dimples, said dimples being uniformly distributed over said exterior surface of said body of said tip.

21. A cosmetic applicator according to claim 20, wherein said dimples are arranged in columns extending longitudinally along said external surface of said body of said tip and in rows extending laterally across said body of said tip.

22. A cosmetic applicator according to claim 21, wherein the center-to-center distance between dimples of adjacent columns is in a range of from about 0.018 inches to about 0.025 inches and wherein the center-to-center distance between dimples of adjacent rows is in a range of from about 0.015 inches to about 0.025 inches.

23. A cosmetic applicator according to claim 16, wherein said body of said tip includes receiving means within said body for receiving a quantity of air sufficient to form an air cushion within said tip.

24. A cosmetic applicator according to claim 23, wherein said receiving means is a cavity formed within said body of said tip.

25. A cosmetic applicator according to claim 24, wherein the size of said cavity is adjustable to thereby vary the effect of said air cushion.

26. A cosmetic applicator according to claim 25, wherein said gripping means is a rigid stem extending partially into said receiving means, whereby said stem cooperates with said tip to form said cavity in said body of said tip.

27. A cosmetic applicator according to claim 16, wherein said body of said tip is injection molded.

28. A cosmetic applicator according to claim 27, wherein said body of said tip is made from a thermoplastic elastomer.

29. A cosmetic applicator according to claim 28, wherein said thermoplastic elastomer has a hardness in a range of about 6 durometer Shore A to about 40 durometer Shore A.

30. A cosmetic applicator according to claim 16, wherein said body is bullet-shaped.

31. A cosmetic applicator according to claim 16, wherein said body has a pair of opposed, slightly convex faces and a peripheral edge interposed between said faces, wherein said dimples are formed on said faces only and wherein said peripheral edge has a plurality of laterally extending grooves, each groove being sized and shaped so as to releasably retain a predetermined quantity of cosmetic.

* * * * *